United States Patent [19]

Brown

[11] Patent Number: 4,892,066

[45] Date of Patent: Jan. 9, 1990

[54] MULTI-CYLINDER TWO-STROKE ENGINE WITH REDUCED COST AND COMPLEXITY

[75] Inventor: Peter W. Brown, Hartland, Wis.

[73] Assignee: Outboard Marine Corporation, Waukegan, Ill.

[21] Appl. No.: 123,357

[22] Filed: Nov. 19, 1987

[51] Int. Cl.[4] ..... F02B 33/04

[52] U.S. Cl. ..... 123/73 V; 123/73 PP

[58] Field of Search ..... 123/73 R, 73 AC, 73 C, 123/73 V, 73 PP

[56] References Cited

U.S. PATENT DOCUMENTS

| | | | |
|---|---|---|---|
| 2,639,699 | 5/1953 | Kiekhaefer | 123/73 V |
| 3,815,559 | 6/1974 | Anderson | 123/73 V |
| 4,690,109 | 9/1987 | Ogasahara et al. | 123/73 PP |
| 4,779,581 | 10/1988 | Maier | 123/73 B |

FOREIGN PATENT DOCUMENTS

| | | | |
|---|---|---|---|
| 111444 | 7/1945 | Austria | 123/73 V |
| 184177 | 10/1922 | United Kingdom . | |

*Primary Examiner*—David A. Okonsky

*Attorney, Agent, or Firm*—Michael, Best & Friedrich

[57] ABSTRACT

Disclosed herein is an internal combustion engine comprising first and second cylinders, first and second crankcases extending respectively from the first and second cylinders, a crankshaft extending through the first and second crankcases, first and second pistons connected to the crankshaft to afford opposite action of the pistons and respectively reciprocally movable in the first and second cylinders to define first and second combustion chambers respectively communicable, subject to piston movement, with the first and second crankcases, first and second air induction passages respectively including first and second reed valves for respectively supplying air to the first and second crankcases, a duct extending between the first and second crankcases, and a valve located in the duct and movable between open and closed positions to respectively permit and prevent fluid flow between the first and second crankcases.

14 Claims, 1 Drawing Sheet

MULTI-CYLINDER TWO-STROKE ENGINE WITH REDUCED COST AND COMPLEXITY

BACKGROUND OF THE INVENTION

Figure 1:
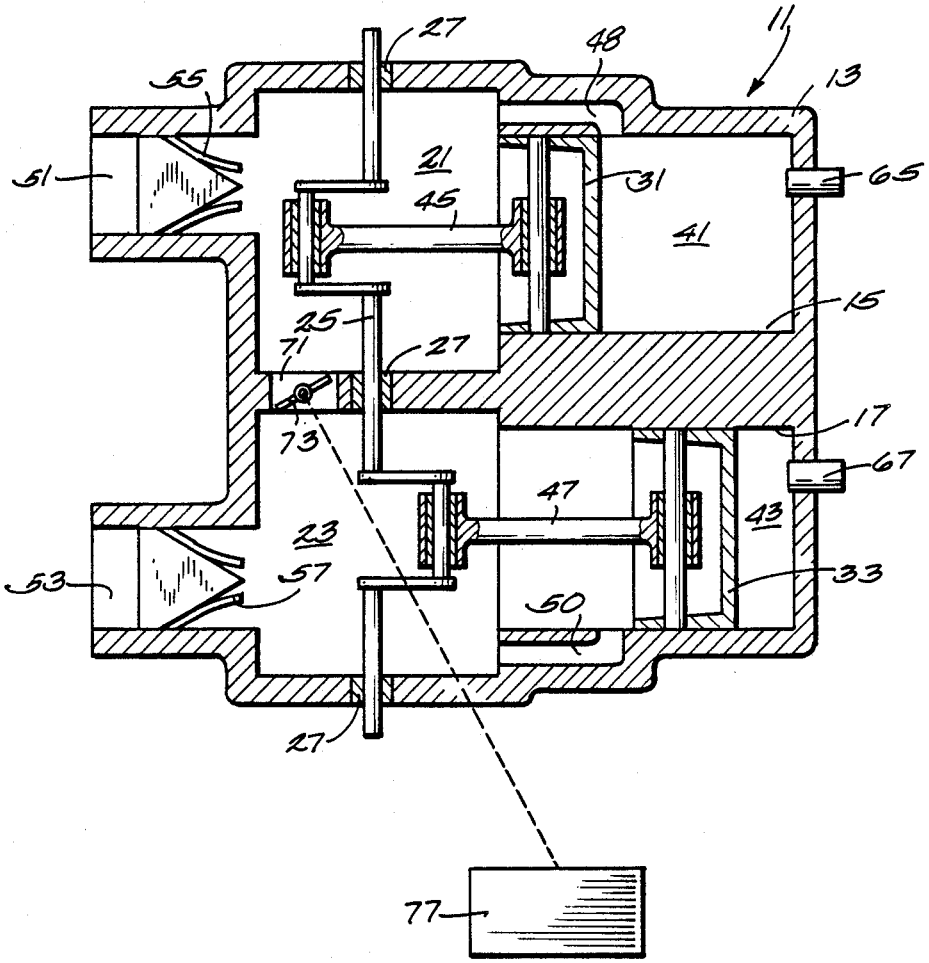

The invention relates generally to internal combustion engines and more particularly to two-stroke internal combustion engines. Still more particularly, the invention relates to multi-cylinder two-stroke internal combustion engines including two-cylinders which operate in an out-of-phase relation to each other.

In conventional two-stroke engines, the engine crankcase is used to pump the engine working fluid (primarily air) from the atmosphere and to purge (scavenge) the cylinder of combustion exhaust components and to replace them with air for the next combustion cycle.

Engine output is typically controlled by throttling air before it passes through a one-way check valve or reed valve before it is inducted into the engine crankcase. In the case of high output engines, one throttle valve is typically provided to control the flow of air through each reed valve into each crankcase. The use of a separate throttle for each cylinder as well as the mechanical linkage needed to operate multiple throttles increases the cost and complexity of an otherwise simple and inexpensive two stroke engine.

SUMMARY OF THE INVENTION

The invention provides an internal combustion engine comprising first and second cylinders, first and second crankcases extending respectively from the first and second cylinders, a crankshaft extending through the first and second crankcases, first and second pistons connected to the crankshaft to afford out-of-phase action of the pistons and respectively reciprocally movable in the first an second cylinders to define first and second combustion chambers respectively communicable, subject to piston movement, with the first and second crankcases, first and second means respectively including first and second reed valves for respectively supplying air to the first an second combustion chambers, a duct extending between the first and second crankcases, and a valve located in the duct and movable between open and closed positions to respectively permit and prevent fluid flow between said first and second crankcases.

The invention also provides an internal combustion engine comprising first and second cylinders, first and second crankcases extending respectively from the first and second cylinders, a crankshaft extending through the first and second crankcases, first and second pistons connected to the crankshaft to afford opposite action of the pistons and respectively reciprocally movable in the first and second cylinders to define first and second combustion chambers respectively communicable, subject to piston movement, with the first and second crankcases, first and second means respectively including first and second reed valves for respectively supplying air to the first and second combustion chambers, a duct extending between the first and second crankcases, and a valve located in the duct and movable between open and closed positions to respectively permit and prevent fluid flow between the first and second crankcases.

In one embodiment of the invention, the engine also includes means for supplying fuel to the first and second combustion chambers.

In one embodiment of the invention, the fuel supply means comprises first and second fuel injectors operable to respectively supply fuel to the first and second combustion chambers.

In one embodiment of the invention, the fuel supply means supplies fuel to the air supply means downstream of the reed valves.

The invention also provides an internal combustion engine comprising first and second cylinders, first and second crankcases extending respectively from the first and second cylinders, a crankshaft extending through the first and second crankcases, first and second pistons respectively reciprocally movable in the first and second cylinders to define first and second combustion chambers and connected to the crankshaft to afford opposite action of the pistons, first and second transfer passages respectively extending from the first and second crankcases and respectively communicating, subject to piston movement, with the first and second combustion chambers, first and second air induction passages, first and second reed valves respectively affording communication between the first and second air induction passages and the first and second crankcases, whereby to afford inflow of air into the crankcases, first and second means for respectively supplying fuel to the first and second combustion chambers, a duct extending between the first and second crankcases, and a valve located in the duct and movable between open and closed positions to respectively permit and prevent fluid flow between the first and second crankcases.

In one embodiment of the invention, the first and second fuel supply means comprises first and second fuel injectors operable to respectively supply fuel to the first and second combustion chambers.

In one embodiment of the invention, the first and second fuel injectors operate to supply fuel directly to the first and second combustion chambers.

A principal object of this invention is to provide means for controlling flow of engine working fluid without incurring high costs associated with providing one throttle for each cylinder and the associated control linkage.

Other features and advantages of the invention will become apparent to those skilled in the art upon review of the following detailed description, claims and drawings.

THE DRAWINGS

FIG. 1 is a schematic view, partially in section, of an internal combustion engine embodying various of the features of the invention.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. In particular, it is understood that this invention is readily applicable to engines with more than two cylinders so long as cylinder pairs exist whose operation occurs in an out-of-phase relationship. Also, it is to be understood that the phraseology and terminology used herein is for the purpose of description and should not be regarded as limiting.

As used herein, out-of-phase refers to a condition wherein two cylinders are not simultaneously fired. Thus, an oppositely acting engine, wherein the cylinders are fired at crankshaft rotational intervals of 180°, is one example of an out-of-phase relationship. In some instances, the invention is applicable to an out-of-phase relationship as small as 30° of crankshaft rotation between firing intervals.

GENERAL DESCRIPTION

Illustrated schematically in the drawings is a two-stroke internal combustion engine 11 which includes an engine block 13 defining first and second cylinders 15 and 17 and first and second crankcases 21 and 23 extending respectively from the first and second cylinders 15 and 17.

The engine 11 also includes a crankshaft 25 which is suitably journaled by a plurality of bearings 27 in the engine block 13 and which extends through the first and second crankcases 21 and 23.

Also included in the engine 11 are first and second pistons 31 and 33 which are reciprocal in the first and second cylinders 15 and 17 to define respective variable volume first and second combustion chambers 41 and 43 and to vary the volume of the first and second crankcases 21 and 23.

In addition, the engine 11 includes first and second connecting rods 45 and 47 which respectively connect the first and second pistons 31 and 33 to the crankshaft 25 to effect crankshaft rotation in response to piston reciprocation and to effect opposite action of the first and second pistons 31 and 33, i.e., to cause the first and second pistons 31 and 33 to travel in opposite directions, that is, to be one-hundred and eighty degrees (180°) out-of-phase.

The engine 11 also includes first and second transfer passages 48 and 50 respectively connecting the first and second crankcases 21 and 23 to the first and second combustion chambers 41 and 43 subject to respective movement of the first and second pistons 31 and 33.

The engine 11 also includes first and second means for respectively supplying air to the first and second combination chambers 41 and 43. While other constructions can be employed, in the disclosed construction, air is supplied to the engine 11 by first and second air induction passages 51 and 53 which respectively communicate with the first and second crankcases 21 and 23 through respective first and second reed or check valves 55 and 57.

The engine 11 also includes means for supplying fuel to the first and second combustion chambers 41 and 43. While other constructions can be employed, in the disclosed construction, fuel is supplied to the air-path downstream of the reed valves 55 and 57. More particularly, any suitable fuel injection system can be used to supply fuel to the engine downstream from the reed valves 55 and 57. In the illustrated construction, first and second fuel injectors 65 and 67 extend into the engine block and deliver fuel to the head end of the combustion chambers 41 and 43. Any other suitable location downstream of the reed valves 55 and 57 can also be employed, such as, for example, locations for delivering fuel to the crankcases 21 and 23 or to the transfer passages 48 and 50. In addition, any suitable construction can be employed to provide the fuel injectors 65 and 67.

Any suitable means can be employed to ignite fuel in the combustion chambers 41 and 43 such as, for instance, respective spark plugs (not shown) extending into the first and second cylinders 15 and 17 and suitably energized by a suitable ignition system (not shown).

As above disclosed, the construction is conventional.

The engine 11 also includes a duct 71 extending between or connecting the crankcases 21 and 23 and having therein a valve 73 movable between open and closed positions respectively permitting and preventing fluid flow between the crankcases 21 and 23. It is additionally noted that the first and second air induction passages 51 and 53 do not include therein throttle valves as is conventional practice.

Suitable means shown schematically at 77 is provided for affecting movement of the valve 73 between the open and closed positions in response to operator activity. Any suitable linkage can be employed. When the engine is operating at low, idle, and cruise speeds, the valve 73 is at least partially opened so as to permit reciprocal air flow between the first and second crankcases 21 and 23, thereby reducing the pressure at which flow occurs through the transfer passages and also reducing the inflow of air through the air induction passages 51 and 53. At high speeds, the valve 73 is closed to permit the crankcases to draw the required amount of air to support engine operation in the normal fashion.

The invention is particularly applicable to multi-cylinder engines which scavenge with pure air and which have fuel injection systems which inject fuel into the engine cylinder.

In operation intake air flows unthrottled through one way check valves (reed valves) into the crankcases of the individual cylinders 15 and 17. Under light load conditions the valve 73 is maintained substantially open so that most of the positive pressure that results due to piston compression of the crankcase volume is bled off into the other crankcase. Therefore very little pressure exists in the crankcases and relatively little fresh air is pumped through the transfer passages, thereby maintaining the engine at a low output condition.

With the valve 73 open, very little vacuum is produced in the crankcases during the piston up-strokes, minimizing pressure loss from high volumes of air being drawing through the intake reed valves.

When increased power output is required the throttle valve is closed proportionally until, under maximum power conditions, the valve is fully closed and the engine otherwise functions like a conventional two-stroke engine.

It is also understood that cost and complexity of an engine may be reduced by adaptation of this invention since the number of throttles required to control output is reduced.

While the invention has been disclosed in connection with a two-cylinder engine, the invention is applicable to multi-cylinder engines of more than two cylinders by "pairing" cylinders which are oppositely acting, or which operate in an out-of-phase relationship with one another.

Various of the features of the invention are set forth in the following claims.

I claim:

1. An internal combustion engine comprising first and second cylinders, first and second crankcases extending respectively from said first and second cylinders, a crankshaft extending through said first and second crankcases, first and second pistons connected to said crankshaft to afford opposite action of said pistons and respectively reciprocally movable in said first and second cylinders to define first and second combustion chambers respectively communicable, subject to piston movement, with said first and second crankcases, first and second means respectively including first and second reed valves for respectively supplying air to said first and second combustion chambers, a duct extending between said first and second crankcases, and a valve located in said duct and movable between open and closed positions to respectively permit and prevent fluid flow in both directions between said first and second crankcases.

2. An internal combustion engine in accordance with claim 1 and further including means for supplying fuel to said first and second combustion chambers.

3. An internal combustion engine in accordance with claim 2 wherein said fuel supply means comprises first and second fuel injectors operable to respectively supply fuel to said first and second combustion chambers.

4. An internal combustion engine in accordance with claim 3 wherein said fuel supply means supplies fuel to said air supply means downstream of said reed valves.

5. An internal combustion engine comprising first and second cylinders, first and second crankcases extending respectively from said first and second cylinders, a crankshaft extending through said first and second crankcases, first and second pistons respectively reciprocally movable in said first and second cylinders to define first and second combustion chambers and connected to said crankshaft to afford opposite action of said pistons, first and second transfer passages respectively extending from said first and second crankcases and respectively communicating, subject to piston movement, with said first and second combustion chambers, first and second air induction passages, first and second reed valves respectively affording communication between said first and second air induction passages and said first and second crankcases, whereby to afford inflow of air into said crankcases, first and second means for respectively supplying fuel to said first and second combustion chambers, a duct extending between said first and second crankcases, and a valve located in said duct and movable between open and closed positions to respectively permit and prevent fluid flow in both directions between said first and second crankcases.

6. An internal combustion engine in accordance with claim 2 wherein said first and second fuel supply means comprises first and second fuel injectors operable to respectively supply fuel to said first and second combustion chambers.

7. An internal combustion engine in accordance with claim 6 wherein said first and second fuel injectors operate to supply fuel directly to said first and second combustion chambers.

8. An internal combustion engine comprising first and second cylinders, first and second crankcases extending respectively from said first and second cylinder, a crankshaft extending through said first and second crankcases, first and second pistons connected to said crankshaft to afford out-of-phase action of said pistons and respectively reciprocally movable in said first and second cylinders to define first and second combustion chambers respectively communicable, subject to piston movement, with said first and second crankcases, first and second means respectively including first and second reed valves for respectively supplying air to said first and second combustion chambers, a duct extending between said first and second crankcases, and a valve located in said duct and movable between open and closed positions to respectively permit and prevent fluid flow in both directions between said first and second crankcases.

9. An internal combustion engine in accordance with claim 8 and further including means for supplying fuel to said first and second combustion chambers.

10. An internal combustion engine in accordance with claim 9 herein said fuel supply means comprises first and second fuel injectors operable to respectively supply fuel to said first and second combustion chambers.

11. An internal combustion engine in accordance with claim 10 wherein said fuel supply means supplies fuel to said air supply means downstream of said reed valves.

12. An internal combustion engine in accordance with claim 1 and further including an operating linkage connected to said valve and adapted to be actuated by an operator to selectively locate said valve within a range defined by said open and closed positions.

13. An internal combustion engine in accordance with claim 5 and further including an operating linkage connected to said valve and adapted to be actuated by an operator to selectively locate said valve within a range defined by said open and closed positions.

14. An internal combustion engine in accordance with claim 8 and further including an operating linkage connected to said valve and adapted to be actuated by an operator to selectively locate said valve within a range defined by said open and closed positions.

* * * * *